US010105756B2

(12) United States Patent
Ownby et al.

(10) Patent No.: US 10,105,756 B2
(45) Date of Patent: Oct. 23, 2018

(54) STEAM-BLOCKING COOLING SYSTEMS THAT HELP FACILITATE DIRECTIONAL SOLIDIFICATION

(71) Applicant: Halliburton Energy Services, Inc., Houston, TX (US)

(72) Inventors: Clayton A. Ownby, Houston, TX (US); Grant O. Cook, III, Spring, TX (US); Garrett T. Olsen, The Woodlands, TX (US); Jeffrey G. Thomas, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 176 days.

(21) Appl. No.: 14/778,967

(22) PCT Filed: Dec. 2, 2014

(86) PCT No.: PCT/US2014/068061
§ 371 (c)(1),
(2) Date: Sep. 21, 2015

(87) PCT Pub. No.: WO2016/089369
PCT Pub. Date: Jun. 9, 2016

(65) Prior Publication Data

US 2016/0325349 A1 Nov. 10, 2016

(51) Int. Cl.
*B22D 27/04* (2006.01)
*B22D 25/02* (2006.01)
(Continued)

(52) U.S. Cl.
CPC ..... *B22D 27/045* (2013.01); *B22C 9/065* (2013.01); *B22C 9/10* (2013.01); *B22C 9/22* (2013.01);
(Continued)

(58) Field of Classification Search
CPC .. B22C 9/06; B22C 9/065; B22C 9/10; B22C 9/22; B22D 23/06; B22D 25/02; B22D 27/04; B22D 27/045
(Continued)

(56) References Cited

U.S. PATENT DOCUMENTS 4,582,681 A 4/1986 Asari et al.
5,275,227 A 1/1994 Staub
(Continued)

FOREIGN PATENT DOCUMENTS

JP 58071301 4/1983

OTHER PUBLICATIONS

International Search Report and Written Opinon for PCT/US2014/068061 dated Aug. 25, 2015.
(Continued)

*Primary Examiner* — Kevin P Kerns
(74) *Attorney, Agent, or Firm* — Alan Bryson; Tumey L.L.P.

(57) ABSTRACT

An example cooling system for a mold assembly includes a quench plate that defines one or more discharge ports and one or more recuperation ports. A fluid is circulated from the one or more discharge ports to the one or more recuperation ports to cool the mold assembly. A blocking ring is positioned on the quench plate and defines a central aperture for receiving a bottom of the mold assembly. An insulation enclosure having an interior for receiving the mold assembly is positioned on the blocking ring. The blocking ring prevents vapor generated by the fluid contacting the bottom of the mold assembly from migrating into the interior of the insulation enclosure.

14 Claims, 8 Drawing Sheets

(51) Int. Cl.

| | |
|---|---|
| ***B22C 9/06*** | (2006.01) |
| ***B22C 9/22*** | (2006.01) |
| ***B22C 9/10*** | (2006.01) |
| ***B22D 19/06*** | (2006.01) |
| ***B22D 19/14*** | (2006.01) |
| ***B22D 23/06*** | (2006.01) |
| ***E21B 10/42*** | (2006.01) |
| *B22F 7/06* | (2006.01) |
| *E21B 10/52* | (2006.01) |

(52) U.S. Cl.
CPC ..... *B22D 19/06* (2013.01); *B22D 19/14* (2013.01); *B22D 23/06* (2013.01); *B22D 25/02* (2013.01); *E21B 10/42* (2013.01); *B22F 7/06* (2013.01); *E21B 10/52* (2013.01)

(58) Field of Classification Search
USPC ..... 164/122, 126, 128, 348, 352
See application file for complete search history.

(56) References Cited

U.S. PATENT DOCUMENTS

| | | | |
|---|---|---|---|
| 6,932,145 | B2 | 8/2005 | Frasier et al. |
| 7,343,960 | B1 | 3/2008 | Frasier et al. |
| 7,377,305 | B2 | 5/2008 | Frasier et al. |
| 7,418,993 | B2 | 9/2008 | Frasier et al. |
| 7,779,890 | B2 | 8/2010 | Frasier et al. |
| 7,824,494 | B2 | 11/2010 | Frasier et al. |
| 8,047,260 | B2 | 11/2011 | Uno et al. |
| 8,082,976 | B2 | 12/2011 | Frasier et al. |
| 8,087,446 | B2 | 1/2012 | Frasier et al. |
| 8,181,692 | B2 | 5/2012 | Frasier et al. |
| 8,272,295 | B2 | 9/2012 | Smith et al. |
| 8,550,144 | B2 | 10/2013 | Frasier et al. |
| 8,622,113 | B1 | 1/2014 | Rau, III |
| 2002/0170700 | A1 | 11/2002 | Yanagimoto et al. |
| 2008/0028891 | A1 | 2/2008 | Calnan et al. |
| 2010/0212860 | A1 | 8/2010 | Rule |
| 2010/0278604 | A1 | 11/2010 | Glass et al. |
| 2011/0167734 | A1 | 7/2011 | Jiang et al. |
| 2013/0313403 | A1 | 11/2013 | Atkins et al. |
| 2013/0333950 | A1 | 12/2013 | Atkins et al. |

OTHER PUBLICATIONS

International Preliminary Report on Patentability from International Patent Application No. PCT/US2014/068061, dated Jun. 15, 2017.

STEAM-BLOCKING COOLING SYSTEMS THAT HELP FACILITATE DIRECTIONAL SOLIDIFICATION

BACKGROUND

Rotary drill bits are often used to drill wellbores. One type of rotary drill bit is a fixed-cutter drill bit that has a bit body comprising matrix and reinforcement materials, i.e., a "matrix drill bit" as referred to herein. Matrix drill bits are typically manufactured by placing powder material into a mold and infiltrating the powder material with a binder material, such as a metallic alloy. The various features of the resulting matrix drill bit, such as blades, cutter pockets, and/or fluid-flow passageways, may be provided by shaping the mold cavity and/or by positioning temporary displacement materials within interior portions of the mold cavity. A preformed bit blank (or steel mandrel) may be placed within the mold cavity to provide reinforcement for the matrix bit body and to allow attachment of the resulting matrix drill bit with a drill string. A quantity of matrix reinforcement material (typically in powder form) may then be placed within the mold cavity with a quantity of the binder material.

The mold is then placed within a furnace and heated to a desired temperature to allow the binder (e.g., metallic alloy) to liquefy and infiltrate the matrix reinforcement material. The furnace typically maintains a desired temperature until the infiltration process is deemed complete, such as when a specific location in the bit reaches a certain temperature. Once the designated process time or temperature has been reached, the mold is then removed from the furnace and begins to rapidly lose heat to its surrounding environment via heat transfer, such as radiation and/or convection in all directions.

This heat loss continues to a large extent until the mold is moved and placed on a cooling or quench plate and an insulation enclosure or "hot hat" is lowered around the mold. The insulation enclosure drastically reduces the rate of heat loss from the top and sides of the mold while heat is drawn from the bottom of the mold through the cooling plate. This controlled cooling of the mold and the infiltrated matrix bit contained therein can facilitate axial solidification dominating radial solidification, which is loosely termed directional solidification. As the molten material of the infiltrated matrix bit cools, there is a tendency for shrinkage that could result in voids forming within the bit body unless the molten material is able to continuously backfill such voids. In some cases, for instance, one or more intermediate regions within the bit body may solidify prior to adjacent regions and thereby stop the flow of molten material to locations where shrinkage porosity is developing. In other cases, shrinkage porosity may result in poor metallurgical bonding at the interface between the bit blank and the molten materials, which can result in the formation of cracks within the bit body that can be difficult or impossible to inspect.

While the mold is positioned on the quench plate, water is often ejected out of one or more nozzles provided in the quench plate to impinge upon the bottom of the mold and thereby promote directional solidification. As it contacts the heated mold, however, the water can generate a significant amount of steam or vapor that often enters the insulation enclosure and increases heat transfer from the upper section of the mold, possibly by wetting the insulation (thereby increasing its conductivity) or by creating or enhancing convective currents inside the insulation enclosure. This additional cooling can produce multiple solidification fronts, which result in blank bond-line cracking, apex cracking, binder-rich zones, bevel cracking, and cracking between nozzles.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to downhole tool manufacturing and, more particularly, to steam-blocking mold assemblies used to help facilitate directional solidification of an infiltrated downhole tool during manufacture.

The embodiments described herein provide cooling systems for cooling a mold assembly following an infiltration process. The cooling systems may include a quench plate and a blocking ring positioned on the quench plate and defining a central aperture for receiving the bottom of the mold assembly. An insulation enclosure may be positioned on the blocking ring such that the mold assembly is positioned within an interior of the insulating enclosure. A fluid may be circulated through various flow channels defined in the quench plate and vapor or steam may be generated as the fluid impinges upon the bottom of the mold assembly. The blocking ring may prove advantageous in interposing the quench plate and the insulation enclosure such that the vapor or steam may be substantially prevented from escaping into the interior of the insulation enclosure and producing unwanted solidification fronts within the mold assembly, which could result in defects caused by lack of thermal control. Instead, the blocking ring may force the vapor or steam to escape either into a fluid reservoir associated with the cooling system or into the surrounding environment.

Figure 1:
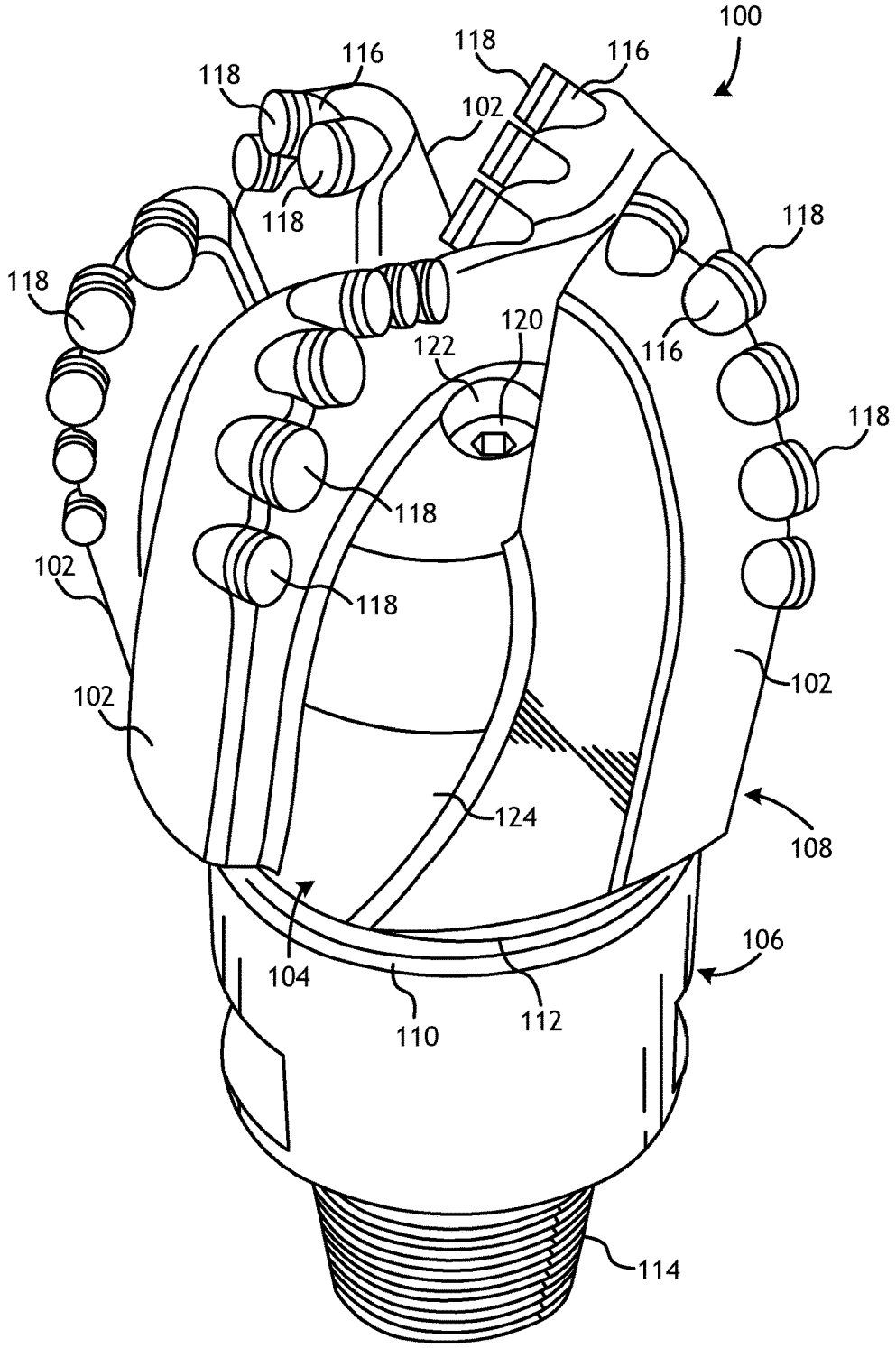
FIG. 1 is a perspective view of an exemplary fixed-cutter drill bit that may be fabricated in accordance with the principles of the present disclosure.

FIG. 1 illustrates a perspective view of an example fixed-cutter drill bit 100 that may be fabricated in accordance with the principles of the present disclosure. It should be noted that, while FIG. 1 depicts a fixed-cutter drill bit 100, the principles of the present disclosure are equally applicable to any type of downhole tool that may be formed or otherwise manufactured through an infiltration process. For example, suitable infiltrated downhole tools that may be manufactured in accordance with the present disclosure include, but are not limited to, oilfield drill bits or cutting tools (e.g., fixed-angle drill bits, roller-cone drill bits, coring drill bits, bi-center drill bits, impregnated drill bits, reamers, stabilizers, hole openers, cutters, cutting elements), non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, washover tools, rotors, stators and/or housings for downhole drilling motors, blades and housings for downhole turbines, and other downhole tools having complex configurations and/or asymmetric geometries associated with forming a wellbore.

As illustrated in FIG. 1, the fixed-cutter drill bit 100 (hereafter "the drill bit 100") may include or otherwise define a plurality of cutter blades 102 arranged along the circumference of a bit head 104. The bit head 104 is connected to a shank 106 to form a bit body 108. The shank 106 may be connected to the bit head 104 by welding, such as using laser, arc, electron beam, or other metal fusion welding methods that result in the formation of a weld 110 around a weld groove 112. The shank 106 may further include or otherwise be connected to a threaded pin 114.

In the depicted example, the drill bit 100 includes five cutter blades 102, in which multiple recesses or pockets 116 are formed. Cutting elements 118 may be fixedly installed within each pocket 116. This can be done, for example, by brazing each cutting element 118 into a corresponding pocket 116. As the drill bit 100 is rotated in use, the cutting elements 118 engage the rock and underlying earthen materials, to dig, scrape or grind away the material of the formation being penetrated.

During drilling operations, drilling fluid or "mud" can be pumped downhole through a drill string (not shown) coupled to the drill bit 100 at the threaded pin 114. The drilling fluid circulates through and out of the drill bit 100 at one or more nozzles 120 positioned in nozzle openings 122 defined in the bit head 104. Junk slots 124 are formed between each adjacent pair of cutter blades 102. Cuttings, downhole debris, formation fluids, drilling fluid, etc., may pass through the junk slots 124 and circulate back to the well surface within an annulus formed between exterior portions of the drill string and the inner wall of the wellbore being drilled.

Figure 2:
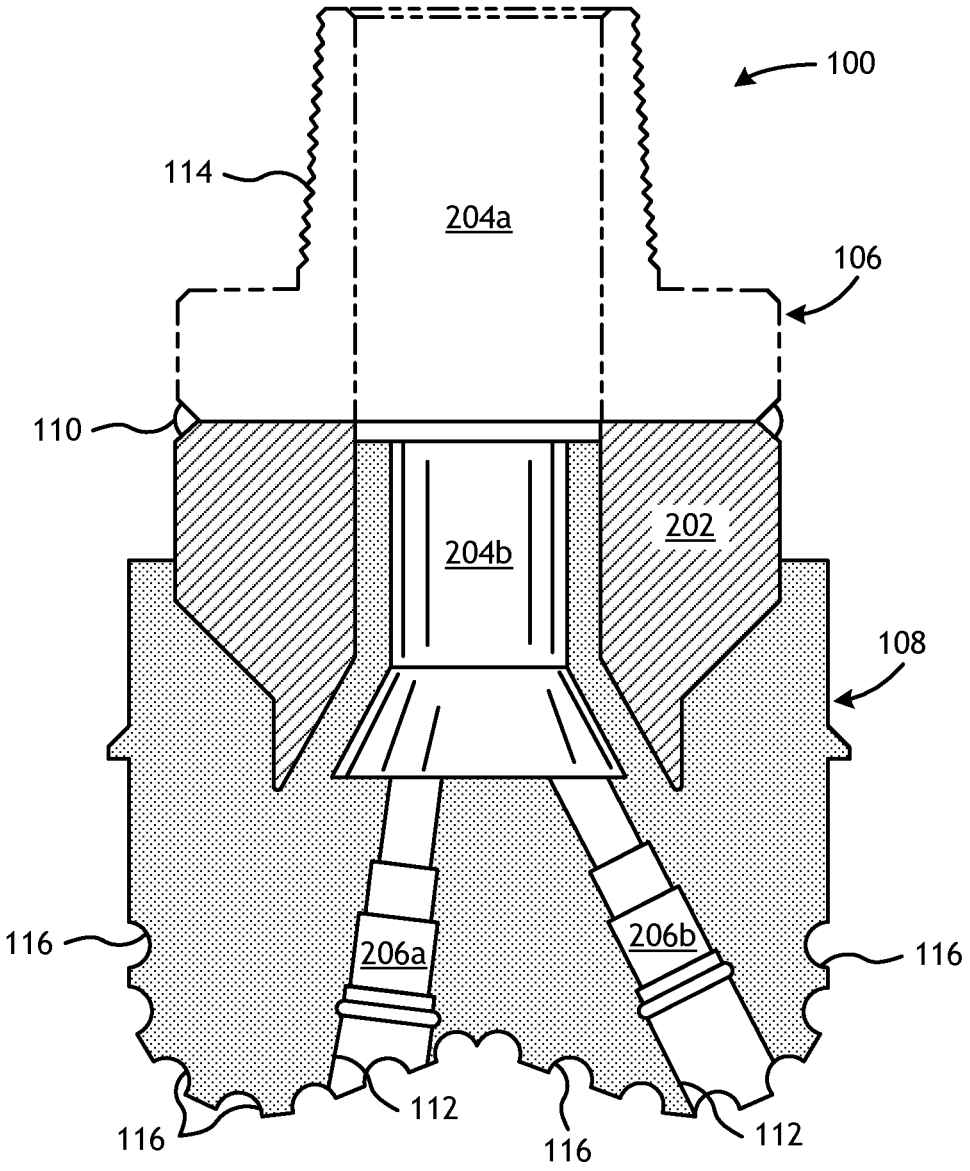
FIG. 2 is a cross-sectional view of the drill bit of FIG. 1.

FIG. 2 is a cross-sectional side view of the drill bit 100 of FIG. 1. Similar numerals from FIG. 1 that are used in FIG. 2 refer to similar components that are not described again. As illustrated, the shank 106 may be securely attached to a metal blank (or mandrel) 202 at the weld 110 and the metal blank 202 extends into the bit body 108. The shank 106 and the metal blank 202 are generally cylindrical structures that define corresponding fluid cavities 204*a* and 204*b*, respectively, in fluid communication with each other. The fluid cavity 204*b* of the metal blank 202 may further extend longitudinally into the bit body 108. At least one flow passageway (shown as two flow passageways 206*a* and 206*b*) may extend from the fluid cavity 204*b* to exterior portions of the bit body 108. The nozzle openings 122 may be defined at the ends of the flow passageways 206*a* and 206*b* at the exterior portions of the bit body 108. The pockets 116 are formed in the bit body 108 and are shaped or otherwise configured to receive the cutting elements 118 (FIG. 1).

Figure 3:
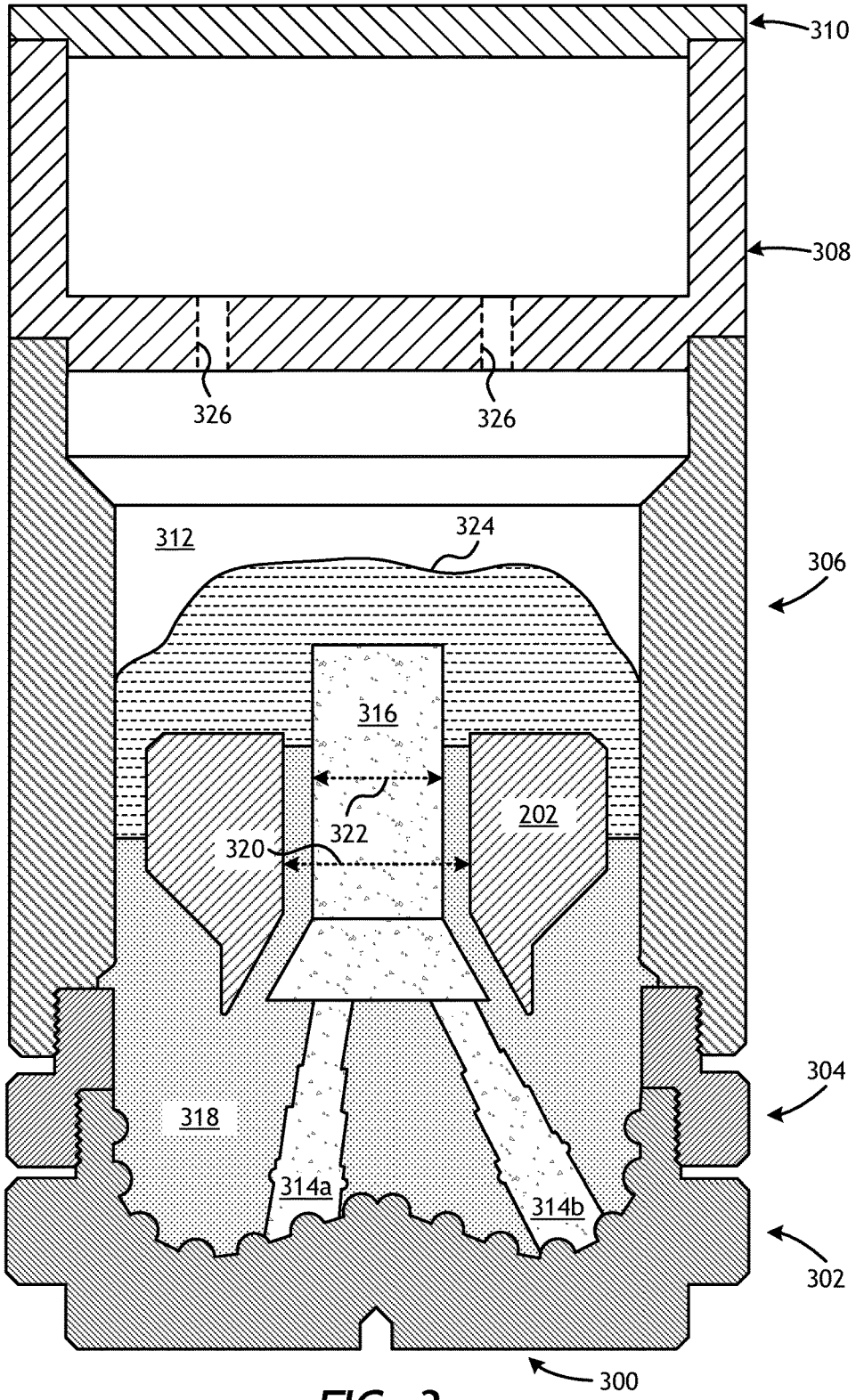
FIG. 3 is a cross-sectional side view of an exemplary mold assembly for use in forming the drill bit of FIG. 1.

FIG. 3 is a cross-sectional side view of a mold assembly 300 that may be used to form the drill bit 100 of FIGS. 1 and 2. While the mold assembly 300 is shown and discussed as being used to help fabricate the drill bit 100, those skilled in the art will readily appreciate that mold assembly 300 and its several variations described herein may be used to help fabricate any of the infiltrated downhole tools mentioned above, without departing from the scope of the disclosure. As illustrated, the mold assembly 300 may include several components such as a mold 302, a gauge ring 304, and a funnel 306. In some embodiments, the funnel 306 may be operatively coupled to the mold 302 via the gauge ring 304, such as by corresponding threaded engagements, as illustrated. In other embodiments, the gauge ring 304 may be omitted from the mold assembly 300 and the funnel 306 may be instead be operatively coupled directly to the mold 302, such as via a corresponding threaded engagement, without departing from the scope of the disclosure.

In some embodiments, as illustrated, the mold assembly 300 may further include a binder bowl 308 and a cap 310 placed above the funnel 306. The mold 302, the gauge ring 304, the funnel 306, the binder bowl 308, and the cap 310 may each be made of or otherwise comprise graphite or alumina ($Al_2O_3$), for example, or other suitable materials. An infiltration chamber 312 may be defined or otherwise provided within the mold assembly 300. Materials, such as consolidated sand or graphite, may be positioned within the mold assembly 300 at desired locations to form various features of the drill bit 100 (FIGS. 1 and 2). For example, consolidated sand legs 314*a* and 314*b* may be positioned to correspond with desired locations and configurations of the flow passageways 206*a,b* (FIG. 2) and their respective nozzle openings 122 (FIGS. 1 and 2). Moreover, a cylindrically-shaped consolidated central displacement 316 may be placed on the legs 314*a,b*. The number of legs 314*a,b* extending from the central displacement 316 will depend upon the desired number of flow passageways and corresponding nozzle openings 122 in the drill bit 100.

After the desired materials, including the central displacement 316 and the legs 314*a,b*, have been installed within the mold assembly 300, matrix reinforcement materials 318 may then be placed within the mold assembly 300. For some applications, two or more different types of matrix reinforcement materials 318 may be deposited in the mold assembly 300. Suitable matrix reinforcement materials 318 include, but are not limited to, tungsten carbide, monotungsten carbide (WC), ditungsten carbide ($W_2C$), macrocrystalline tungsten carbide, other metal carbides, metal borides, metal oxides, metal nitrides, natural and synthetic diamond, and polycrystalline diamond (PCD). Examples of other metal carbides may include, but are not limited to, titanium carbide and tantalum carbide, and various mixtures of such materials may also be used.

The metal blank 202 may be supported at least partially by the matrix reinforcement materials 318 within the infiltration chamber 312. More particularly, after a sufficient volume of the matrix reinforcement materials 318 has been added to the mold assembly 300, the metal blank 202 may then be placed within mold assembly 300. The metal blank 202 may include an inside diameter 320 that is greater than an outside diameter 322 of the central displacement 316, and various fixtures (not expressly shown) may be used to position the metal blank 202 within the mold assembly 300 at a desired location. The matrix reinforcement materials 318 may then be filled to a desired level within the infiltration chamber 312.

Binder material 324 may then be placed on top of the matrix reinforcement materials 318, the metal blank 202, and the central displacement 316. Various types of binder materials 324 may be used and include, but are not limited to, metallic alloys of copper (Cu), nickel (Ni), manganese (Mn), lead (Pb), tin (Sn), cobalt (Co), phosphorous (P) and silver (Ag). Various mixtures of such metallic alloys may also be used as the binder material 324. In some embodiments, the binder material 324 may be covered with a flux layer (not expressly shown). The amount of binder material 324 and optional flux material added to the infiltration chamber 312 should be at least enough to infiltrate the matrix reinforcement materials 318 during the infiltration process. In some instances, some or all of the binder material 324 may be placed in the binder bowl 308, which may be used to distribute the binder material 324 into the infiltration chamber 312 via various conduits 326 that extend therethrough. The cap 310 (if used) may then be placed over the mold assembly 300, thereby readying the mold assembly 300 for heating.

Figure 4A:
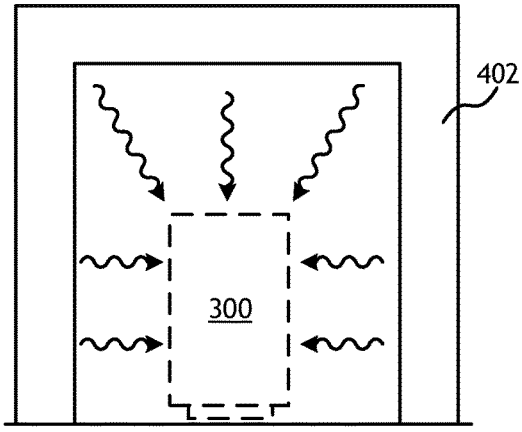
FIGS. 4A-4C are progressive schematic diagrams of an exemplary method of fabricating a drill bit.
Figure 4B:
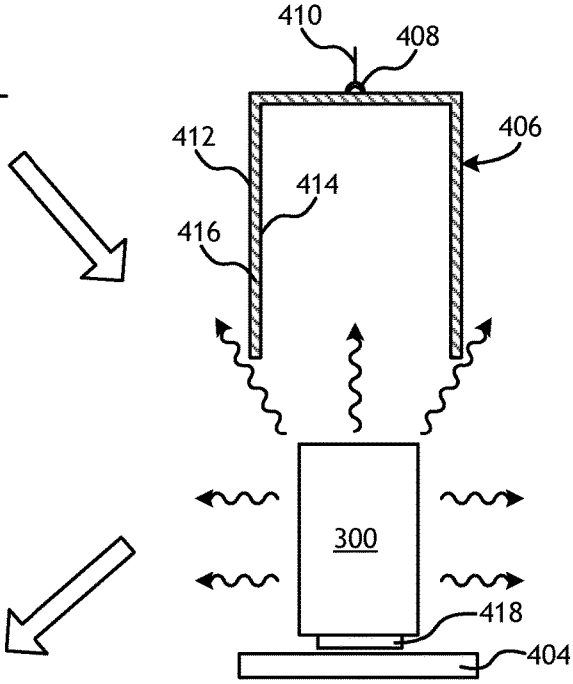
Figure 4C:
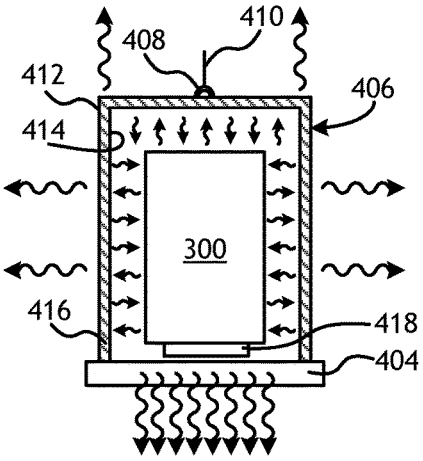

Referring now to FIGS. 4A-4C, with continued reference to FIG. 3, illustrated are schematic diagrams that sequentially illustrate an example method of heating and cooling the mold assembly 300 of FIG. 3, in accordance with the principles of the present disclosure. In FIG. 4A, the mold assembly 300 is depicted as being positioned within a furnace 402. The temperature of the mold assembly 300 and its contents are elevated within the furnace 402 until the binder material 324 liquefies and is able to infiltrate the matrix reinforcement materials 318. Once a specific location in the mold assembly 300 reaches a certain temperature in the furnace 402, or the mold assembly 300 is otherwise maintained at a particular temperature for a predetermined amount of time, the mold assembly 300 is then removed from the furnace 402 and immediately begins to lose heat by radiating thermal energy to its surroundings while heat is also convected away by cooler air outside the furnace 402.

As depicted in FIG. 4B, the mold assembly 300 may be transported to and set down upon a thermal heat sink 404. The radiative and convective heat losses from the mold assembly 300 to the environment continue until an insulation enclosure 406 is lowered around the mold assembly 300. The insulation enclosure 406 may be a rigid shell or structure used to insulate the mold assembly 300 and thereby slow the cooling process. In some cases, the insulation enclosure 406 may include a hook 408 attached to a top surface thereof. The hook 408 may provide an attachment location whereby the insulation enclosure 406 may be grasped and/or otherwise attached to for transport. For instance, a chain or wire 410 may be coupled to the hook 408 to lift and move the insulation enclosure 406, as illustrated.

The insulation enclosure 406 may include an outer frame 412, an inner frame 414, and insulation material 416 arranged between the outer and inner frames 412, 414. In some embodiments, both the outer frame 412 and the inner frame 414 may be made of rolled steel and shaped (i.e., bent, welded, etc.) into the general shape, design, and/or configuration of the insulation enclosure 406. In other embodiments, the inner frame 414 may be a metal wire mesh that holds the insulation material 416 between the outer frame 412 and the inner frame 414. The insulation material 416 may be selected from a variety of insulative materials. In at least one embodiment, the insulation material 416 may be a ceramic fiber blanket, such as INSWOOL® or the like.

As depicted in FIG. 4C, the insulation enclosure 406 may enclose the mold assembly 300 such that thermal energy radiating from the mold assembly 300 is dramatically reduced from the top and sides of the mold assembly 300 and is instead directed substantially downward and otherwise toward/into the thermal heat sink 404 or back towards the mold assembly 300. The thermal heat sink 404 may comprise a cooling plate designed to circulate a fluid (e.g., water) at a reduced temperature relative to the mold assembly 300 (i.e., at or near ambient) to draw thermal energy from the mold assembly 300 and into the circulating fluid, and thereby reduce the temperature of the mold assembly 300.

Once the insulation enclosure 406 is positioned over the mold assembly 300 and the thermal heat sink 404 is operational, the majority of the thermal energy is transferred away from the mold assembly 300 through the bottom 418 of the mold assembly 300 and into the thermal heat sink 404. This controlled cooling of the mold assembly 300 and its contents allows an operator to regulate or control the thermal profile of the mold assembly 300 to a certain extent and may result in directional solidification of the molten contents within the mold assembly 300, where axial solidification of the molten contents dominates radial solidification. Within the mold assembly 300, the face of the drill bit (i.e., the end of the drill bit that includes the cutters) may be positioned at the bottom 418 of the mold assembly 300 and otherwise adjacent the thermal heat sink 404 while the shank 106 (FIG. 1) may be positioned adjacent the top of the mold assembly 300. As a result, the drill bit 100 (FIGS. 1 and 2) may be cooled axially upward, from the cutters 118 (FIG. 1) toward the shank 106 (FIG. 1). Such directional solidification (from the bottom up) may prove advantageous in reducing the occurrence of voids due to shrinkage porosity, cracks at the interface between the metal blank (FIGS. 2 and 3) and the molten materials, and nozzle cracks.

Figure 5A:
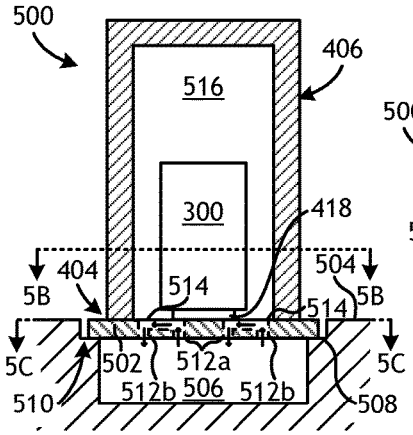
FIGS. 5A-5C are views of a cooling system used to cool the mold assembly of FIG. 3.
Figure 5B:
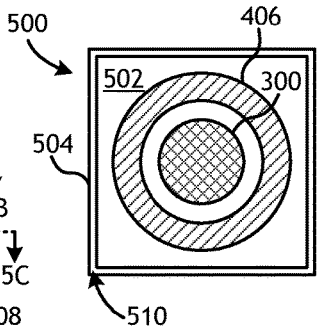
Figure 5C:
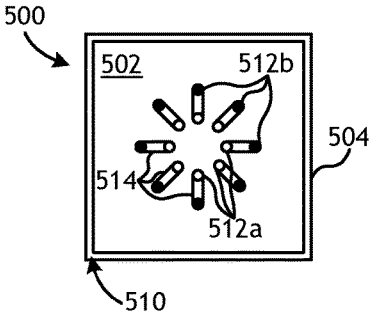

Referring now to FIGS. 5A-5C, with continued reference to FIGS. 4A-4C, illustrated are views of a cooling system 500 that may be used to cool the mold assembly 300. More particularly, FIG. 5A depicts a partial cross-sectional side view side of the cooling system 500, FIG. 5B depicts a cross-sectional top view of the cooling system 500 taken along the lines 5B-5B in FIG. 5A, and FIG. 5C depicts a top view of the cooling station taken along the lines 5C-5C in FIG. 5A. As illustrated, the mold assembly 300 may be positioned on the thermal heat sink 404 and the insulation enclosure 406 may be disposed about the mold assembly 300 and rest on the thermal heat sink 404.

The thermal heat sink 404 may include a quench plate 502, a table 504 that supports the quench plate 502, and a fluid reservoir 506 disposed below the quench plate 502. The table 504 may provide or otherwise define one or more shoulders 508 configured to receive and support the quench plate 502 above the fluid reservoir 506. As illustrated, a gap 510 may be defined between the table 504 and the quench plate 502. As best seen in FIGS. 5B and 5C, the quench plate 502 may exhibit a generally square shape, and the gap 510 may also be square to accommodate the shape of the quench plate 502. In other embodiments, however, the quench plate 502 may exhibit other shapes, such as circular, ovoid, or other polygonal shapes (e.g., rectangular, etc.).

As seen in FIGS. 5A and 5C, the quench plate 502 may facilitate the circulation of a fluid used to cool the mold assembly 300. In some embodiments, the fluid may be water, but could also be a polymer solution, oil, glycol, a salt, or another heat transfer medium or any mixture of multiple heat transfer mediums. As illustrated, the quench plate 502 may provide or define one or more discharge ports 512*a*, one or more recuperation ports 512*b*, and flow channels 514 that provide fluid communication between corresponding pairs of discharge and recuperation ports 512*a,b*. In some embodiments, one or more of the discharge ports 512*a* may include a nozzle (not shown) configured to eject the fluid out of the discharge port 512*a* and toward the bottom 418 of the mold assembly 300.

In operation, the fluid (e.g., water) is provided to the discharge ports 512*a* and flowed into the flow channels 514 to come into direct contact with the bottom 418 of the mold assembly 300. As the fluid contacts the mold assembly 300, heat may be transferred from the mold assembly 300 to the fluid as the fluid circulates. The fluid flows along the flow channels 514 and eventually all or a portion thereof flows into the fluid reservoir 506 via the recuperation ports 512*b*. In some cases, some of the fluid may flow past the recuperation ports 512*b*, underneath the sidewalls of the insulation enclosure 406, and subsequently flow into the gap 510, which may allow the fluid to drop into the fluid reservoir 506.

As the fluid contacts and otherwise impinges upon the bottom 418 of the mold assembly 300, steam or vapor may be generated and may escape into an interior 516 of the insulation enclosure 406 and thereby increase the heat transfer from the upper portions of the mold assembly 300. As used herein, the term "vapor" refers to any gasified liquid including, but not limited to, water vapor in the form of steam. This additional cooling can produce unwanted solidification fronts within the mold assembly 300, which could result in defects caused by lack of thermal control. The embodiments of the present disclosure describe several concepts for reducing or eliminating the vapor from accessing the interior 516 of the insulation enclosure 406.

Figure 6A:
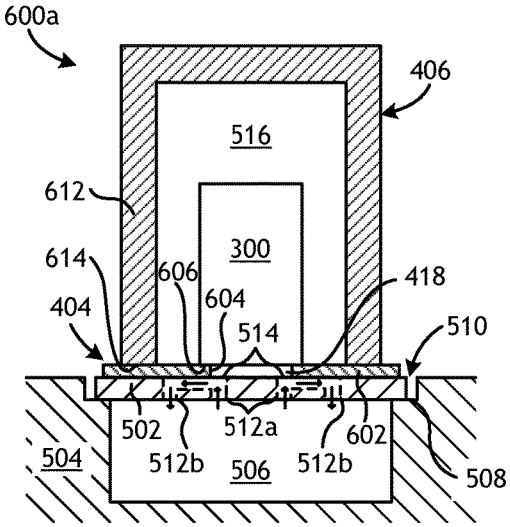
FIGS. 6A and 6B are partial cross-sectional side views of exemplary cooling systems that may be used to cool the mold assembly of FIG. 3.
Figure 6B:
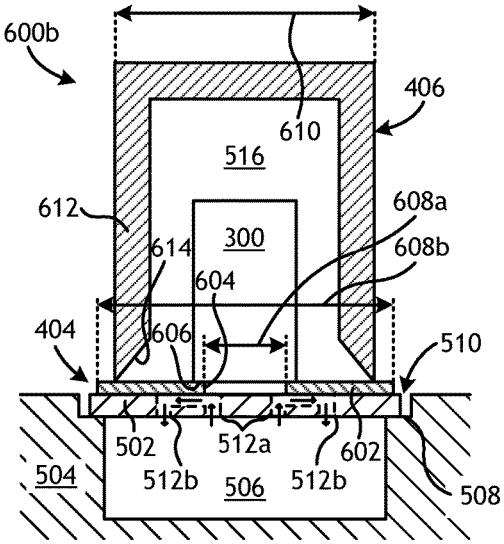

Referring now to FIGS. 6A and 6B, illustrated are partial cross-sectional side views of exemplary cooling systems 600*a* and 600*b*, respectively, used to cool the mold assembly 300, according to one or more embodiments. The cooling systems 600*a,b* of FIGS. 6A-6B may be similar in some respects to the cooling system 500 of FIGS. 5A-5C and therefore may be best understood with reference thereto, where like numerals indicate like components or elements not described again in detail. Similar to the cooling system 500 of FIGS. 5A-5C, the cooling system 600*a,b* may include the thermal heat sink 404, which includes the quench plate 502, the table 504 that supports the quench plate 502, and the fluid reservoir 506. The insulation enclosure 406 may also be disposable about the mold assembly 300.

Unlike the cooling system 500 of FIGS. 5A-5C, however, the cooling system 600 may further include a blocking ring 602 that interposes the insulation enclosure 406 and the quench plate 502. More particularly, the blocking ring 602 (hereafter "the ring 602") may be configured to be positioned atop the quench plate 502, and the insulation enclosure 406 may engage and otherwise rest on the upper surface of the ring 602. The ring 602 may define a central aperture 604 configured to receive the bottom 418 of the mold assembly 300 while the remaining portions of the mold assembly 300 may rest on the upper surface of the ring 602 at a shoulder 606. The shoulder 606 may be defined on the mold assembly 300 and otherwise comprise a structural feature of the mold 302 of FIG. 3.

The central aperture 604 may exhibit any shape that matches the cross-sectional shape of the bottom 418 of the mold assembly 300. In some embodiments, for instance, the central aperture 604 may be circular to match a circular-shaped bottom 418. In other embodiments, however, the central aperture 604 may exhibit a polygonal shape, such as square or rectangular, to match a correspondingly polygonal-shaped bottom 418, without departing from the scope of the disclosure. Likewise, the outer dimensions of the ring 602 may exhibit a variety of shapes that allow the insulation enclosure 406 to rest entirely on the upper surface of the ring 406. In some embodiments, for instance, the ring 602 may be circular to generally match a circular insulation enclosure 406. In other embodiments, however, the ring 602 may exhibit a polygonal shape, such as square or rectangular, without departing from the scope of the disclosure.

In FIG. 6B, the central aperture 604 is depicted as exhibiting a first or inner dimension 608*a* and the ring 602 as a whole is depicted as exhibiting a second or outer dimension 608*b*. In embodiments where the central aperture 604 and the ring 602 are circular in shape, the inner and outer dimensions 608*a,b* may comprise corresponding diameters of the central aperture 604 and the ring 602, respectively. The inner dimension 608*a* may be slightly larger than the size of the bottom 418 such that the bottom 418 may be received into the central aperture 604 in a mating engagement. In some embodiments, for example, the bottom 418 may be received into the central aperture 604 via an interference fit or nearly an interference fit. The outer dimension 608*b* may be larger than a width 610 (FIG. 6B) of the insulation enclosure 406 such that the insulation enclosure 406 is able to rest entirely on the ring 602.

In some embodiments, the wall(s) of the inner dimension 608*a* and the bottom 418 may be complimentarily angled (e.g., slanted outward). This may prove advantageous in embodiments where the mold 302 exhibits dimensions that do not allow it to rest flush with the upper surface of the ring 602. In such embodiments, the weight of mold assembly 300 may serve to produce a tight fit between the bottom 418 and the ring 602. In this manner, vapor is blocked by the radial surfaces. In other embodiments, however, the inner dimension 608*a* may be slightly smaller than the size of the bottom 418 such that the these surfaces do not touch and the vapor is instead blocked by the interface between the shoulder 606 resting on the supper surface of the ring 602. Furthermore, such a configuration could be enhanced by forming a recessed mating shoulder in the ring 602 (ideal for a thicker ring) to accommodate the shoulder 606 and/or the outer radial surface of the mold assembly 300. Accordingly, the vapor can be blocked by any combination of three surface interfaces: the bottom 418 and the inner dimension 608*a*, the upper surface of the ring 602 and the shoulder 606, and/or inner dimension on a recessed shoulder (not quite 608*a*) and the outer radial surface of the mold assembly 300.

The ring 602 may be configured to block vapor from entering into the insulation enclosure 406 while the thermal heat sink 404 operates. More particularly, vapor may be generated as the fluid from the discharge ports 512*a* impinges upon the bottom 418 of the mold assembly 300. The ring 602, however, may prevent the vapor from migrating into the interior 516 of the insulation enclosure 406. For instance, because of the tight-fitting mating engagement between the bottom 418 and the central aperture 604, vapor may be unable to traverse the ring 602 into the insulation enclosure 406 at the interface between the central aperture 604 and the bottom 418. Instead, the vapor is forced to flow along the flow channels 514 with the fluid and otherwise along the bottom of the ring 602 at the interface between the ring 602 and the quench plate 502. Some of the vapor may flow radially outward and enter the fluid reservoir 506 via the recuperation ports 512*b* with some of the fluid. In other cases, some of the vapor may migrate radially outward along the interface between the ring 602 and the quench plate 502 until eventually escaping into the surrounding environment outside of the insulation enclosure 406. In some embodiments, upon contacting the cooler air of the surrounding environment, the vapor may condense and flow into the fluid reservoir 506 via the gap 510.

One difference between the cooling systems 600*a* and 600*b* is the design of the insulation enclosure 406 in each system. More particularly, in FIG. 6A the sidewall 612 of the insulation enclosure 406 may have a sidewall end 614 that is polygonally-shaped and otherwise provides a flat or planar (annular) surface area that engages the upper surface of the ring 602. In contrast, the sidewall end 614 of the insulation enclosure 406 in FIG. 6B may be angled and otherwise engage the upper surface of the ring 602 at a point. As will be appreciated, several other configurations or designs for the sidewall end 614 may be employed such as, but not limited to, a rounded sidewall end 614, a grooved sidewall end 614, etc., without departing from the scope of the disclosure. Such mating surfaces may prevent any vapor that escapes from the interface between the ring 602 and the quench plate 502 from entering the interior 516 by forming a suitable seal between the ring 602 and insulation enclosure 406. Furthermore, this interface may be designed to insulate the insulation enclosure 406 from the quench plate 502 and thereby help maintain heat in the insulation enclosure 406. This can be achieved by either adding an insulating material to a blocked sidewall end 614 or utilizing minimal contact, as in the angled sidewall end 614, or a combination thereof.

The ring 602 may be made of a thermally conductive or insulative material that helps facilitate heat transfer between the mold assembly 300 and the quench plate 502 or that helps localize the heat transfer to the surface(s) of the mold assembly 300 that interface with the quench plate 502. Suitable materials for the ring 602 include, but are not limited to, a ceramic (e.g., oxides, carbides, borides, nitrides, silicides), a metal (e.g., steel, stainless steel, nickel, tungsten, titanium or alloys thereof), graphite, a composite material (e.g., metal-matrix composites, ceramic-matrix composites, etc.), and any combination thereof. Accordingly, the ring 602 may not only prove advantageous in blocking vapor from entering the insulation enclosure 406 to eliminate or slow unwanted solidification fronts in the mold assembly 300, but may also help transfer thermal energy from the bottom 418 of the mold assembly 300 and thereby enhance directional solidification of the molten contents within the mold assembly 300. Alternatively, the ring 602 may help prevent the insulation enclosure 406 from losing heat to the quench plate 502, and thereby help maintain high temperature around the upper portions of the mold assembly 300. Furthermore, the ring 602 may be a composite body formed of a conductive material (e.g., steel) in proximity to the mold assembly 300 and an insulative material in proximity to the insulation enclosure 406.

Figure 7A:
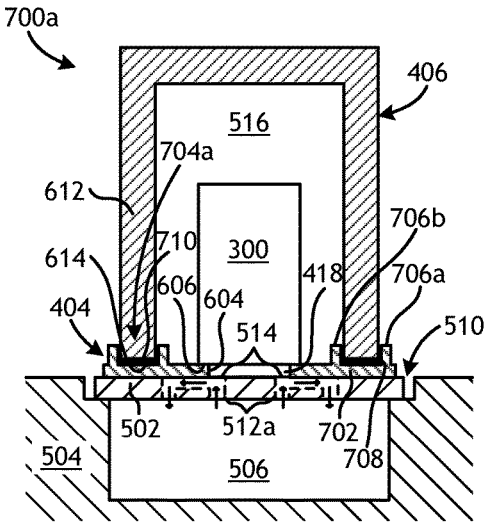
FIGS. 7A and 7B are partial cross-sectional side views of exemplary cooling systems that may be used to cool the mold assembly of FIG. 3.
Figure 7B:
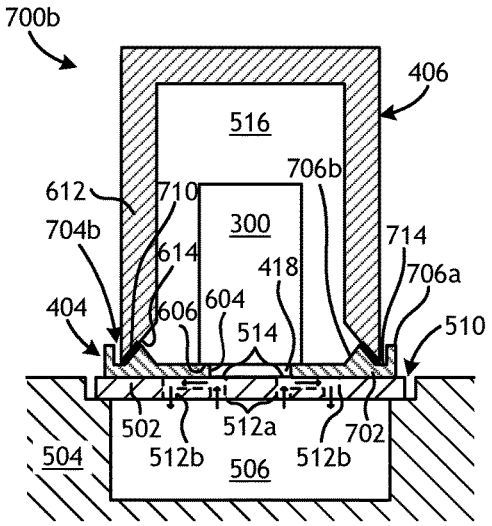

Referring now to FIGS. 7A and 7B, illustrated are partial cross-sectional side views of exemplary cooling systems 700*a* and 700*b*, respectively, that may be used to cool the mold assembly 300, according to one or more embodiments. The cooling systems 700*a,b* of FIGS. 7A-7B may be similar in some respects to the cooling systems 600*a,b* of FIGS. 6A-6B and therefore may be best understood with reference thereto, where like numerals indicate like components or elements not described again. Similar to the cooling systems 600*a,b* of FIGS. 6A-6B, the cooling systems 700*a,b* may include the thermal heat sink 404, which includes the quench plate 502, the table 504 that supports the quench plate 502, and the fluid reservoir 506. The insulation enclosure 406 may also be disposable about the mold assembly 300.

Moreover, similar to the cooling systems 600*a,b* of FIGS. 6A-6B, the cooling systems 700*a,b* may further include a blocking ring 702 that interposes the insulation enclosure 406 and the quench plate 502. The blocking ring 702 (hereafter "the ring 702") may be similar to the ring 602 and, therefore, may define the central aperture 604 configured to receive the bottom 418 of the mold assembly 300 while the remaining portions of the mold assembly 300 may rest on the upper surface of the ring 702 at the shoulder 606. Moreover, similar to the ring 602, the ring 702 may be configured to block vapor from entering into the insulation enclosure 406 while the thermal heat sink 404 operates, as generally described above.

Unlike the ring 602, however, the ring 702 may include or otherwise define one or more alignment features (shown as alignment features 704*a* and 704*b* in FIGS. 7A and 7B, respectively) used to ensure proper alignment of the insulation enclosure 406 with respect to the mold assembly 300. The alignment features 704*a,b* may be configured to receive and seat various geometries, sizes, and configurations of the sidewall end 614 of the insulation enclosure 406. In FIG. 7A, for example, the sidewall end 614 of the insulation enclosure 406 is generally polygonal and provides a flat or planar surface area that engages the upper surface of the ring 702. The alignment feature 704*a* of FIG. 7A may be configured to receive the polygonally-shaped sidewall end 614. More particularly, the alignment feature 704*a* may provide or otherwise define an outer lip 706*a*, an inner lip 706*b*, and a trough 708 that extends between the outer and inner lips 706*a,b*. As illustrated, the trough 708 may be generally planar and otherwise configured to receive and seat the polygonally-shaped sidewall end 614 while the outer and inner lips 706*a,b* may operate to prevent lateral movement of the insulation enclosure 406 with respect to the mold assembly 300. Such positioning features help to ensure that the gap between the mold assembly 300 and the insulation enclosure 406 is uniform in all directions, thereby creating more uniform thermal gradients in the upper portions of the mold assembly 300.

In some embodiments, the alignment features 704*a,b* may include a seal 710 disposed between the sidewall end 614 and the trough 708 to further prevent vapor communication between the interior 516 of the insulation enclosure 406 and the hot surfaces producing the vapor. The seal 710 may comprise, in some cases, a sealing material that fills or partially fills the alignment features 704*a,b*. Moreover, in at least one embodiment, the alignment features 704*a,b* (e.g., the trough 708) may be filled with or contain an insulating material to prevent heat transfer from the insulating enclosure 406 to the ring 702, or other similar features.

In FIG. 7B, the sidewall end 614 is angled and the alignment feature 704*b* may be configured to receive the angled sidewall end 614. More particularly, the alignment feature 704*b* may provide or otherwise define the outer lip 706*a*, but the inner lip 706*b* may be complementarily angled to receive the angled surface of the sidewall end 614. Accordingly, the angled sidewall end 614 of the insulation enclosure 406 may be received into the trough 714, where the outer lip 706*a* and complimentary angled surfaces of the inner lip 706*b* and the angled sidewall end 614 may operate to prevent lateral movement of the insulation enclosure 406 with respect to the mold assembly 300.

As will be appreciated, the alignment features 704*a,b* not only prove advantageous in ensuring proper alignment of the insulation enclosure 406 with respect to the mold assembly 300, but may also provide a tortuous flow path for vapor. More particularly, the alignment features 704*a,b* require any vapor present in the surrounding environment to migrate across a tortuous flow path before accessing the interior 516 of the insulation enclosure 406. As a result, the alignment features 704*a,b* may help prevent the influx of vapor into the insulation enclosure 406. Furthermore, such alignment features enhance, promote, or make possible the use of a controlled atmosphere in the interior 516. With suitable sealing, a gas, such as argon or helium, could be flowed into the interior 516 at an elevated temperature to promote directional solidification of the contents of the mold assembly 300 by insulating the upper portions of mold assembly 300 while its bottom portion is cooled via the quench plate 502.

Figure 8A:
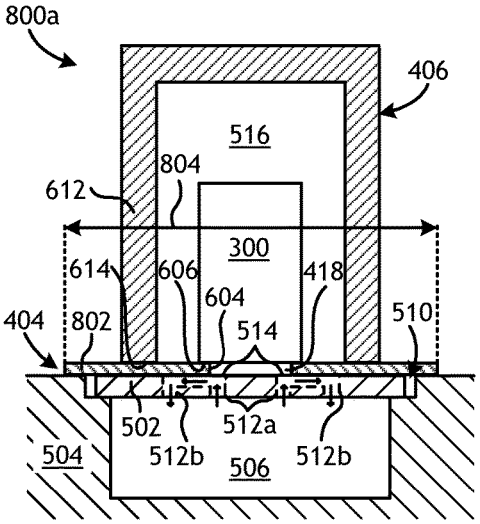
FIGS. 8A and 8B are partial cross-sectional side views of exemplary cooling systems that may be used to cool the mold assembly of FIG. 3.
Figure 8B:
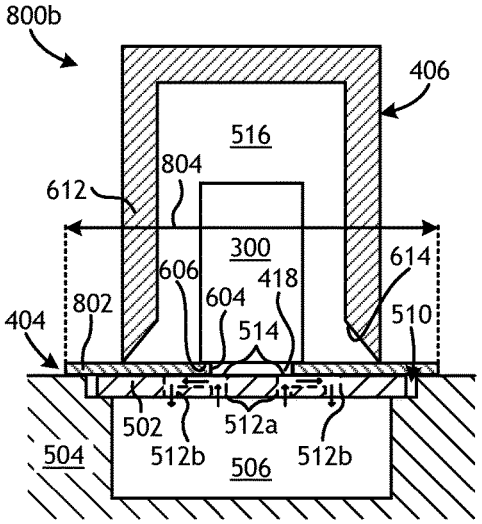

Referring now to FIGS. 8A and 8B, illustrated are partial cross-sectional side views of exemplary cooling systems 800*a* and 800*b*, respectively, that may be used to cool the mold assembly 300, according to one or more embodiments. The cooling systems 800*a,b* of FIGS. 8A-8B may be similar in some respects to the cooling systems 600*a,b* of FIGS. 6A-6B and therefore may be best understood with reference thereto, where like numerals indicate like components or elements not described again. The insulation enclosure 406 of FIG. 8A may be similar to the insulation enclosure 406 of FIG. 6A, where the sidewall 612 defines a polygonally-shaped sidewall end 614. Moreover, the insulation enclosure 406 of FIG. 8B may be similar to the insulation enclosure 406 of FIG. 6B, where the sidewall 612 defines the angled sidewall end 614.

Similar to the cooling systems 600*a,b* of FIGS. 6A-6B, the cooling systems 800*a,b* may include a blocking ring 802 that interposes the insulation enclosure 406 and the quench plate 502. The blocking ring 802 (hereafter "the ring 802") may be similar to the ring 602 and, therefore, may define the central aperture 604 configured to receive the bottom 418 of the mold assembly 300 while the remaining portions of the mold assembly 300 may rest on the upper surface of the ring 802 at the shoulder 606. Moreover, similar to the ring 602, the ring 802 may be configured to block vapor from entering into the insulation enclosure 406 while the thermal heat sink 404 operates, as generally described above.

Unlike the ring 602, however, the ring 802 may exhibit an outer dimension 804 that is large enough to cover and otherwise extend across the gap 510 defined between the table 504 and the quench plate 502. As a result, any vapor migrating along the bottom of the ring 802 at the interface between the ring 802 and the quench plate 502 may eventually be diverted into the gap 510 and thereafter into the fluid reservoir 506. In such a design, the cooling fluid and vapor can be completely contained within the thermal heat sink 404 (including the fluid reservoir 506, the quench plate 502, and the gap 510). As will be appreciated, a self-contained cooling system is more amenable to the use of higher flow rates or different cooling media, such as a coolant or a gas.

Figure 9A:
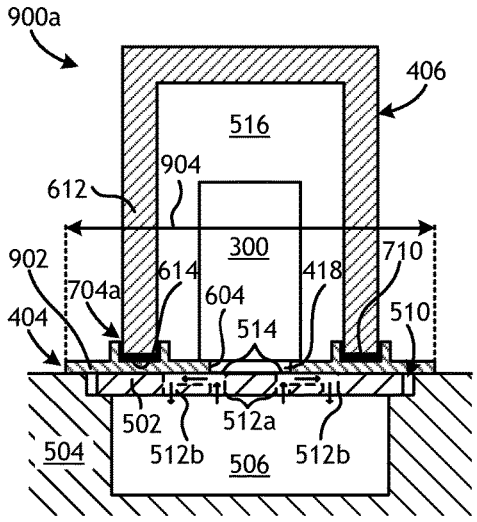
FIGS. 9A and 9B are partial cross-sectional side views of exemplary cooling systems that may be used to cool the mold assembly of FIG. 3.
Figure 9B:
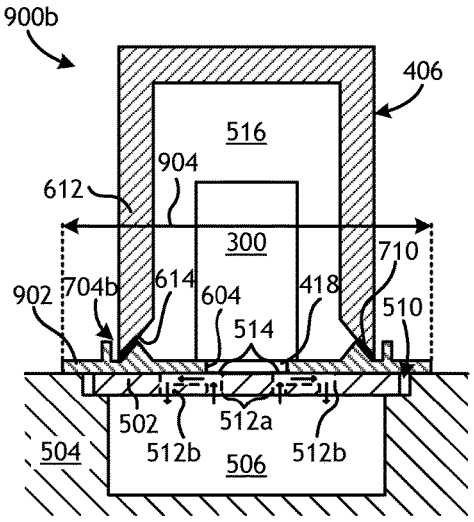

Referring now to FIGS. 9A and 9B, illustrated are partial cross-sectional side views of exemplary cooling systems 900*a* and 900*b*, respectively, that may be used to cool the mold assembly 300, according to one or more embodiments. The cooling systems 900*a,b* of FIGS. 9A-9B may be similar in some respects to the cooling systems 700*a,b* of FIGS. 7A-7B and therefore may be best understood with reference thereto, where like numerals indicate like components or elements not described again in detail. For instance, the insulation enclosure 406 of FIG. 9A may be similar to the insulation enclosure 406 of FIG. 7A, where the sidewall 612 defines the polygonally-shaped blocked end 614. Moreover, the insulation enclosure 406 of FIG. 9B may be similar to the insulation enclosure 406 of FIG. 7B, where the sidewall 612 defines the angled sidewall end 614.

Similar to the cooling systems 700*a,b* of FIGS. 7A-7B, the cooling systems 900*a,b* may include a blocking ring 902 that interposes the insulation enclosure 406 and the quench plate 502. The blocking ring 902 (hereafter "the ring 902") may be similar to the ring 702 and, therefore, may define the central aperture 604 configured to receive the bottom 418 of the mold assembly 300 and may block vapor from entering into the insulation enclosure 406 while the thermal heat sink 404 operates, as generally described above. Furthermore, to ensure proper alignment of the insulation enclosure 406 with respect to the mold assembly 300, the ring 902 in FIG. 9A may include or otherwise define the alignment feature 704*a* of FIG. 7A, and the ring 902 in FIG. 9B may include or otherwise define the alignment feature 704*b* of FIG. 7B.

Unlike the ring 702 of FIGS. 7A-7B, however, the ring 902 may exhibit an outer dimension 904 that is large enough to cover and otherwise extend across the gap 510 defined between the table 504 and the quench plate 502. As a result, any vapor migrating along the bottom of the ring 902 at the interface between the ring 902 and the quench plate 502 may eventually be diverted into the gap 510 and thereafter into fluid reservoir 506.

Figure 10A:
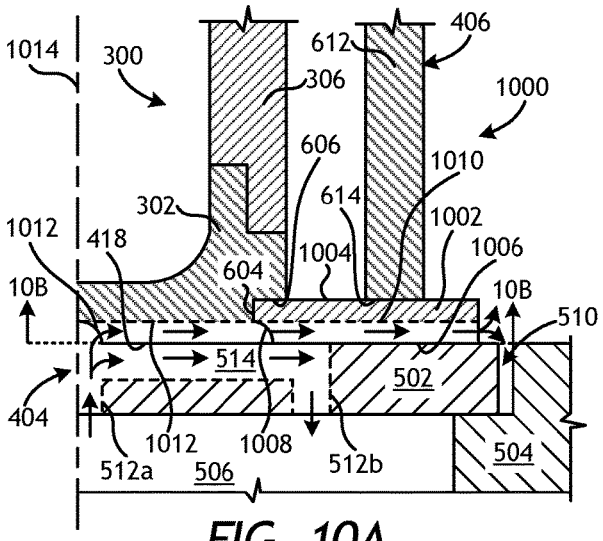
FIGS. 10A and 10B are partial cross-sectional side views of exemplary cooling systems that may be used to cool the mold assembly of FIG. 3.
Figure 10B:
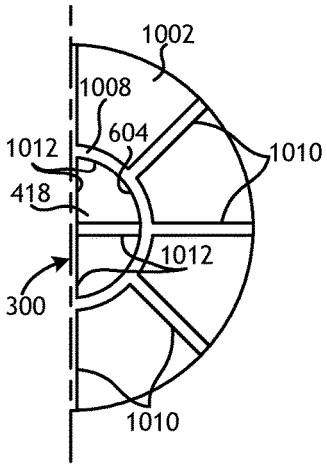

Referring now to FIGS. 10A and 10B, illustrated are views of another exemplary cooling system 1000 that may be used to cool the mold assembly 300, according to one or more embodiments. More particularly, FIG. 10A is a cross-sectional side view of the cooling system 1000, and FIG. 10B is a bottom view of a portion of the cooling system 1000 as taken along the lines 10B-10B of FIG. 10A. The cooling system 1000 may be similar to any of the cooling systems described herein and, therefore, may include the thermal heat sink 404, which includes the quench plate 502, the table 504 that supports the quench plate 502, and the fluid reservoir 506. The mold assembly 300 is depicted in FIG. 10A as including at least the mold 302 and the funnel 306 operatively coupled thereto, but could alternatively have the gauge ring 304 (FIG. 3) interposing the mold 302 and the funnel 306. The insulation enclosure 406 may be disposable about the mold assembly 300 and, as shown in FIG. 10A, may include the polygonally-shaped sidewall end 614 on its sidewall 612. It will be appreciated, however, that the sidewall 612 may equally provide the angled sidewall end 614 as shown in FIGS. 6B, 7B, 8B, and 9B.

The cooling system 1000 may further include a blocking ring 1002 that interposes the insulation enclosure 406 and the quench plate 502. The blocking ring 1002 (hereafter "the ring 1002") may be similar in some respects to any of the blocking rings described herein. For instance, the ring 1002 may be configured to be positioned atop the quench plate 502, and the insulation enclosure 406 may engage and otherwise rest on an upper surface 1004 of the ring 1002. Moreover, the ring 1002 may define the central aperture 604 configured to receive the bottom 418 of the mold assembly 300 while the remaining portions of the mold assembly 300 rest on the upper surface 1004 of the ring 1002 at the shoulder 606 provided by the mold 302. While not shown, it will be appreciated that either of the alignment features

704*a* and 704*b* of FIGS. 7A-7B and 9A-9B may also be provided by the ring 1002 to ensure proper alignment of the insulation enclosure 406 with respect to the mold assembly 300, without departing from the scope of the disclosure.

In some embodiments, as best seen in FIG. 10B, the ring 1002 may comprise two or more arcuate portions or segments. In such embodiments, the mold assembly 300 may be placed on the quench plate 502 and the arcuate portions of the ring 1002 may then be positioned or arranged about the outer periphery of the bottom 418 of the mold assembly 300. In FIG. 10B, a first arcuate portion of the ring 1002 is depicted in the shape of a semicircle. It will be appreciated, however, that the arcuate portions of the ring 1002 may equally form other smaller fractions of a circle (i.e., quarter circles, etc.) or a polygonal shape, without departing from the scope of the disclosure.

In some embodiments, one or more channels may be defined in an underside 1006 of the ring 1002 to provide additional routes for vapor to escape beyond the flow channels 514 and the recuperation ports 512*b* of the quench plate 502. More particularly, as best seen in FIG. 10B, the ring 1002 may provide or otherwise define an annular flow channel 1008 and one or more radial flow channels 1010 that fluidly communicate with the annular flow channel 1008 and otherwise extend radially therefrom. With the ring 1002 positioned on the quench plate 502, the annular and radial flow channels 1008, 1010 may fluidly communicate with the flow channels 514 of the quench plate 502 such that vapor may be able to migrate along the radial flow channels 1010 and escape into the surrounding environment outside of the insulation enclosure 406, in some embodiments, upon contacting the cooler air of the surrounding environment, the vapor may condense and flow into the fluid reservoir 506 via the gap 510. As a result, vapor may be generally prevented from entering the insulation enclosure 406 in the cooling system 1000.

In some embodiments, one or more channels may also be defined in the bottom 418 of the mold assembly 300 to allow vapor to fluidly communicate into the annular and radial flow channels 1008, 1010 of the ring 1002. More particularly, the bottom 418 of the mold assembly 300 may provide or otherwise define one or more transverse flow channels 1012 that originate and otherwise fluidly communicate directly with the discharge ports 512*a* of the quench plate 502. The transverse flow channels 1012 may extend radially outward from the centerline 1014 of the mold assembly 300 and fluidly communicate with the annular flow channel 1008 of the ring 1002. The annular flow channel 1008 may prove advantageous in allowing channel misalignment or unequal flow channel count between the transverse flow channels 1012 of the mold assembly 300 and the radial flow channels 1010 of the ring 1002, while still facilitating fluid flow that allows the vapor to exit the cooling system 1000 without entering the insulation enclosure 406.

In at least one embodiment, instead of providing the annular and radial flow channels 1008, 1010 of the ring 1002 and the transverse flow channels 1012 of the mold, or in addition thereto, additional channels (not shown) may be machined into the upper surface of the quench plate 502 to effectively extend the flow channels 514 radially to the gap 510. As will be appreciated, this may create a more robust path for the vapor to be evacuated from the cooling system 1000 while potentially simplifying the geometry of the bottom 418 of the mold assembly 300.

As mentioned above, the bottom 418 of the mold assembly 300 may be received into the central aperture 604 via an interference fit or nearly an interference fit such that vapor is substantially prevented from migrating into the insulation enclosure 406 at the interface between the central aperture 604 and the shoulder 606 of the mold 302. In such embodiments, the ring 1002 (or any of the blocking rings described herein) may be secured to the mold assembly 300 via the interference fit such that the ring 1002 may be able to travel with the mold assembly 300 as the mold assembly 300 is transported between various locations. For example, the ring 1002 as secured to the bottom 418 may be able to travel with the mold assembly 300 to a preheat station, to the furnace 402 (FIG. 4A), and from the furnace 402 to the thermal heat sink 404. In other embodiments, the ring 1002 (or any of the blocking rings described herein) may be secured to the mold assembly 300 via one or more mechanical fasteners or mating surfaces (such as a keyhole recess and corresponding protrusion) or the like such that the ring 1002 may likewise be able to travel with the mold assembly 300 to its various destinations, without departing from the scope of the disclosure.

Figure 11:
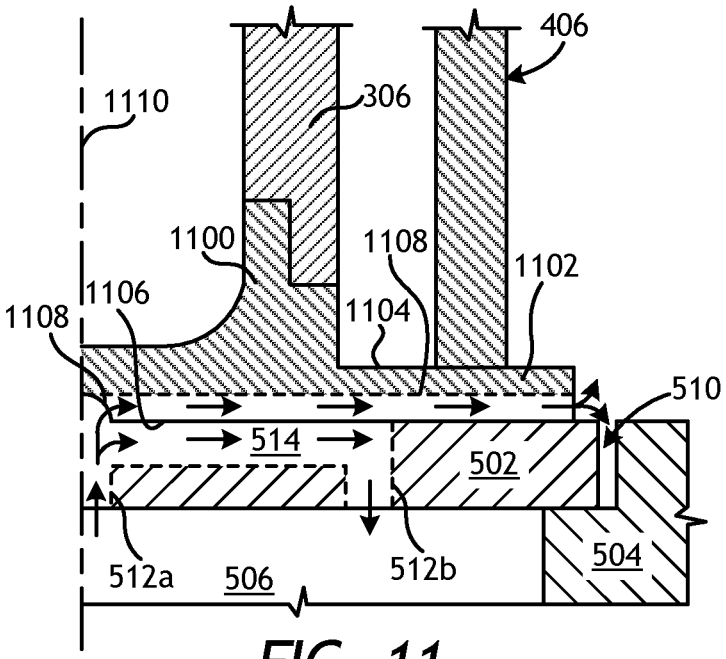
FIG. 11 is a cross-sectional side view of an exemplary mold.

In yet other embodiments, the ring 1002 (or any of the blocking rings described herein) may form an integral part of the mold assembly 300. More particularly, and with reference to FIG. 11, illustrated is an exemplary mold 1100 with the funnel 306 operatively coupled thereto, according to one or more embodiments. The mold 1100 may have a ring portion 1102 that extends laterally and/or radially from the mold 1100. The ring portion 1102 may serve the same function as any of the blocking rings described herein in preventing vapor from entering the interior 516 of the insulation enclosure 406. For instance, as illustrated, the insulation enclosure 406 may rest on an upper surface 1104 of the ring portion 1102 and thereby prevent vapor from bypassing the mold 1100 and entering the interior 516 of the insulation enclosure 406. The ring portion 1102, however, may form an integral portion and or extension of the mold 1100 such that the ring portion 1102 and the mold 1100 form a monolithic structure that can be placed on the quench plate 502. In such embodiments, the mold 1100 and the ring portion 1102 may be made of the same material and otherwise considered a single component of the mold assembly 300.

Moreover, an underside 1106 of the mold 1100 may provide or otherwise define one or more transverse flow channels 1108 that originate and otherwise fluidly communicate directly with the discharge ports 512*a* of the quench plate 502. The transverse flow channels 1108 may fluidly communicate with the flow channels 514 of the quench plate 502 and may extend radially outward from the centerline 1110 of the mold assembly 300 such that vapor may be able to migrate along the transverse flow channels 1108 and escape into the surrounding environment outside of the insulation enclosure 406. In some embodiments, upon contacting the cooler air of the surrounding environment, the vapor may condense and flow into the fluid reservoir 506 via the gap 510. As a result, the vapor may be generally prevented from entering the insulation enclosure 406.

It will be appreciated that the various embodiments described and illustrated herein may be combined in any combination, in keeping within the scope of this disclosure. Indeed, variations in the size and configuration of any of the blocking rings described herein may be implemented in any of the embodiments, as generally described herein. Likewise, variations in the size and configuration of any of the cooling systems that incorporate the presently described blocking rings may be implemented according to any of the presently described embodiments, without departing from the scope of the disclosure.

Embodiments disclosed herein include:

A. A cooling system for a mold assembly that includes a quench plate that defines one or more discharge ports and one or more recuperation ports, wherein a fluid is circulated from the one or more discharge ports to the one or more recuperation ports to cool the mold assembly, a blocking ring positioned on the quench plate and defining a central aperture for receiving a bottom of the mold assembly, and an insulation enclosure having an interior for receiving the mold assembly and one or more sidewalls engageable with an upper surface of the blocking ring, wherein vapor is generated by the fluid contacting the bottom of the mold assembly and the blocking ring prevents the vapor from migrating into the interior of the insulation enclosure.

B. A method of cooling a mold assembly that includes positioning a blocking ring on a quench plate that defines one or more discharge ports and one or more recuperation ports, positioning a bottom of the mold assembly within a central aperture defined in the blocking ring, positioning an insulation enclosure over the mold assembly such that the mold assembly is received into an interior of the insulation enclosure and one or more sidewalls of the insulation enclosure engage an upper surface of the blocking ring, circulating a fluid from the one or more discharge ports to the one or more recuperation ports to cool the mold assembly, and thereby generating vapor as the fluid contacts the bottom of the mold assembly, and preventing the vapor from migrating into the interior of the insulation enclosure with the blocking ring.

Each of embodiments A and B may have one or more of the following additional elements in any combination: Element 1: wherein the blocking ring comprises a material selected from the group consisting of a ceramic, a metal, graphite, a composite material, and any combination thereof. Element 2: further comprising a table having a shoulder that receives and supports the quench plate, and a fluid reservoir arranged below the quench plate and in fluid communication with the one or more discharge ports. Element 3: wherein a gap is defined between the table and the quench plate and the blocking ring exhibits an outer dimension large enough to cover the gap, and wherein the fluid reservoir is in fluid communication with the gap. Element 4: wherein the mold assembly defines a shoulder that engages the upper surface of the blocking ring when the bottom of the mold assembly is received into the central aperture. Element 5: wherein the central aperture provides an inner dimension that receives the bottom of the mold assembly such that the vapor is prevented from migrating into the interior of the insulation enclosure at an interface between the central aperture and the bottom. Element 6: wherein the central aperture receives the bottom of the mold assembly in an interference fit. Element 7: wherein the one or more sidewalls define a sidewall end engageable with the upper surface of the blocking ring, the cooling system further comprising an alignment feature defined on the upper surface of the blocking ring to receive the sidewall end, the alignment feature including an outer lip, an inner lip, and a trough extending between the outer and inner lips, wherein the sidewall end is receivable within the trough and the outer and inner lips operate to prevent lateral movement of the insulation enclosure with respect to the mold assembly. Element 8: further comprising a seal interposing the sidewall end and the trough. Element 9: further comprising insulating material disposed within the trough. Element 10: wherein the blocking ring comprises two or more arcuate portions positionable about an outer periphery of the bottom of the mold assembly. Element 11: wherein the quench plate defines flow channels that fluidly communicate the one or more discharge ports with the one or more recuperation ports, and the blocking ring further comprises an annular flow channel defined in an underside of the blocking ring and in fluid communication with the flow channels of the quench plate, and one or more radial flow channels defined in the underside of the blocking ring and in fluid communication with the annular flow channel. Element 12: further comprising one or more transverse flow channels defined in the bottom of the mold assembly and in fluid communication with the annular flow channel. Element 13: wherein the blocking ring forms an integral part of the mold assembly.

Element 14: wherein the mold assembly defines a shoulder, the method further comprising engaging the shoulder on the upper surface of the blocking ring when the bottom of the mold assembly is received into the central aperture and thereby supporting the mold assembly. Element 15: wherein positioning the bottom of the mold assembly within the central aperture comprises receiving the bottom of the mold assembly into the central aperture in an interference fit. Element 16: further comprising transporting the blocking ring with the mold assembly as the bottom of the mold assembly is received into the central aperture in the interference fit. Element 17: further comprising receiving an end of the one or more sidewalls in an alignment feature defined on the upper surface of the blocking ring, and preventing lateral movement of the insulation enclosure with respect to the mold assembly with the alignment feature. Element 18: further comprising sealing an interface between the end of the one or more sidewalls and the alignment feature with a seal. Element 19: further comprising insulating an interface between the end of the one or more sidewalls and the alignment feature with insulation material disposed within the alignment feature. Element 20: wherein the blocking ring comprises two or more arcuate portions and positioning the bottom of the mold assembly within the central aperture comprises positioning the two or more arcuate portions about an outer periphery of the bottom of the mold assembly. Element 21: wherein the quench plate defines flow channels that fluidly communicate the one or more discharge ports with the one or more recuperation ports, and an annular flow channel and one or more radial flow channels are defined in an underside of the blocking ring and in fluid communication with the flow channels of the quench plate, the method further comprising flowing the vapor in the annular flow channel and the one or more radial flow channels. Element 22: wherein one or more transverse flow channels are defined in the bottom of the mold assembly and in fluid communication with the annular flow channel, the method further comprising flowing the vapor in the one or more transverse flow channels to the annular flow channel.

By way of non-limiting example, exemplary combinations applicable to A, B, and C include: Element 2 with Element 3; Element 5 with Element 6; Element 7 with Element 8; Element 7 with Element 9; Element 11 with Element 12; Element 17 with Element 18; and Element 17 with Element 19.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A cooling system for a mold assembly, comprising:

a quench plate that defines one or more discharge ports and one or more recuperation ports, the one or more discharge ports and one or more recuperation ports being connected by one or more flow channels that, when the cooling system receives the mold assembly, are in fluid communication with the mold assembly for circulating a fluid to be in contact with the mold assembly and to cool the mold assembly;

a blocking ring positioned on the quench plate and defining a central aperture for receiving a bottom of the mold assembly; and an insulation enclosure having an interior for receiving the mold assembly and one or more sidewalls engageable with an upper surface of the blocking ring, wherein vapor is generated by the fluid contacting the bottom of the mold assembly and the blocking ring prevents the vapor from migrating into the interior of the insulation enclosure.

2. The cooling system of claim 1, wherein the blocking ring comprises a material selected from the group consisting of a ceramic, a metal, graphite, a composite material, and any combination thereof.

3. The cooling system of claim 1, further comprising:

a table having a shoulder that receives and supports the quench plate; and a fluid reservoir arranged below the quench plate and in fluid communication with the one or more discharge ports.

4. The cooling system of claim 3, wherein a gap is defined between the table and the quench plate and the blocking ring exhibits an outer dimension larger than the gap, and wherein the fluid reservoir is in fluid communication with the gap.

5. The cooling system of claim 1, wherein the mold assembly defines a shoulder that engages the upper surface of the blocking ring when the bottom of the mold assembly is received into the central aperture.

6. The cooling system of claim 1, wherein the central aperture provides an inner dimension that receives the bottom of the mold assembly such that the vapor is prevented from migrating into the interior of the insulation enclosure at an interface between the central aperture and the bottom.

7. The cooling system of claim 6, wherein the central aperture receives the bottom of the mold assembly in an interference fit.

8. The cooling system of claim 1, wherein the one or more sidewalls define a sidewall end engageable with the upper surface of the blocking ring, the cooling system further comprising an alignment feature defined on the upper surface of the blocking ring to receive the sidewall end, the alignment feature including:

an outer lip;

an inner lip; and a trough extending between the outer and inner lips, wherein the sidewall end is receivable within the trough and the outer and inner lips operate to prevent lateral movement of the insulation enclosure with respect to the mold assembly.

9. The cooling system of claim 8, further comprising a seal interposing the sidewall end and the trough.

10. The cooling system of claim 8, further comprising insulating material disposed within the trough.

11. The cooling system of claim 1, wherein the blocking ring comprises two or more arcuate portions positionable about an outer periphery of the bottom of the mold assembly.

12. The cooling system of claim 1, wherein the blocking ring further comprises:

an annular flow channel defined in an underside of the blocking ring and in fluid communication with the flow channels of the quench plate; and one or more radial flow channels defined in the underside of the blocking ring and in fluid communication with the annular flow channel.

13. The cooling system of claim 12, further comprising one or more transverse flow channels defined in the bottom of the mold assembly and in fluid communication with the annular flow channel.

14. The cooling system of claim 1, wherein the blocking ring forms an integral part of the mold assembly.

* * * * *